US008849172B2

(12) United States Patent
Kunii et al.

(10) Patent No.: US 8,849,172 B2
(45) Date of Patent: Sep. 30, 2014

(54) GLOSSING DEVICE, FIXING DEVICE, AND IMAGE FORMING APPARATUS INCORPORATING SAME

(75) Inventors: Hiroyuki Kunii, Kanagawa (JP); Akiyasu Amita, Kanagawa (JP); Kunihiko Tomita, Kanagawa (JP); Satoshi Muramatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 140 days.

(21) Appl. No.: 13/454,671

(22) Filed: Apr. 24, 2012

(65) Prior Publication Data

US 2012/0328343 A1 Dec. 27, 2012

(30) Foreign Application Priority Data

Jun. 21, 2011 (JP) ..... 2011-137462

(51) Int. Cl.
*G03G 15/20* (2006.01)

(52) U.S. Cl.
USPC ..... 399/341

(58) Field of Classification Search
CPC ..... G03G 15/2017; G03G 15/2021; G03G 15/6573; G03G 15/6582; G03G 15/6585; G03G 2215/00426; G03G 2215/00805; G03G 2215/0081
USPC ..... 399/329, 341; 219/216
See application file for complete search history.

(56) References Cited

U.S. PATENT DOCUMENTS 5,099,288 A * 3/1992 Britto et al. ..... 399/320
5,527,657 A 6/1996 Takeda et al.
5,638,159 A 6/1997 Kai et al.
5,797,074 A 8/1998 Kasahara et al.
5,815,784 A 9/1998 Kasahara et al.
5,953,567 A 9/1999 Muramatsu et al.
5,960,246 A 9/1999 Kasahara et al.
5,987,298 A 11/1999 Muramatsu et al.
6,112,046 A 8/2000 Suzuki et al.
6,201,941 B1 3/2001 Kasahara et al.
6,370,350 B2 4/2002 Tomita
6,370,352 B1 4/2002 Tomita
6,393,241 B1 5/2002 Matsumoto et al.
6,413,690 B2 7/2002 Tomita
6,455,217 B2 9/2002 Tomita (Continued)

FOREIGN PATENT DOCUMENTS

CN 101035675 A 9/2007
JP 05072926 A 3/1993

(Continued)

*Primary Examiner* — Robert Beatty

(74) *Attorney, Agent, or Firm* — Harness, Dickey & Pierce, P.L.C.

(57) ABSTRACT

A fixing device includes a first roller, a second roller, an endless rotary belt, a third roller, a heater, a belt cooler, and an upstream guide member. The second roller is disposed parallel to the first roller. The endless rotary belt is looped for rotation around the first and second rollers. The third roller is disposed opposite the first roller via the belt. The heater is positioned adjacent to the belt to heat the belt. The first and third rollers press against each other via the belt to form a nip therebetween. The belt cooler is disposed inside the loop of the belt downstream from the first roller and upstream from the second roller for cooling the belt. The belt cooler has a convex contact surface. The upstream guide member is disposed inside the loop of the belt upstream from the contact surface to guide the belt.

13 Claims, 4 Drawing Sheets

(56) References Cited

U.S. PATENT DOCUMENTS 6,492,084 B2 12/2002 Tomita
6,505,016 B2 1/2003 Tomita
6,507,720 B2 1/2003 Kabumoto et al.
6,519,439 B2 2/2003 Tomita
6,526,246 B2 2/2003 Iwata et al.
6,542,707 B2 4/2003 Muramatsu et al.
6,567,637 B2 5/2003 Yanagisawa et al.
6,571,076 B2 5/2003 Kasahara et al.
6,597,883 B2 7/2003 Muramatsu et al.
6,608,983 B2 8/2003 Terazawa et al.
6,623,897 B2 9/2003 Tomita
6,628,908 B2 9/2003 Matsumoto et al.
6,628,913 B2 9/2003 Matsumoto et al.
6,628,915 B2 9/2003 Muramatsu et al.
6,653,039 B2 11/2003 Tomita
6,678,492 B1 1/2004 Terazawa et al.
6,748,190 B2 6/2004 Yanagisawa et al.
6,771,926 B2 * 8/2004 Ishikawa et al. ..... 399/329
6,778,788 B2 8/2004 Tomita et al.
6,785,496 B2 8/2004 Iwata et al.
6,813,464 B2 11/2004 Amita et al.
6,819,892 B2 11/2004 Nakazato et al.
6,826,381 B2 11/2004 Muramatsu et al.
6,871,034 B2 3/2005 Muramatsu et al.
6,882,812 B2 4/2005 Kasahara et al.
6,898,405 B2 5/2005 Matsumoto et al.
6,924,074 B2 8/2005 Tomita
6,939,614 B2 9/2005 Tomita
6,957,036 B2 10/2005 Kikuchi et al.
6,983,117 B2 1/2006 Sohmiya et al.
7,003,251 B2 2/2006 Suzuki et al.
7,010,257 B2 3/2006 Someya et al.
7,031,648 B2 4/2006 Takashi et al.
7,039,346 B2 5/2006 Terazawa et al.
7,043,179 B2 5/2006 Matsumoto et al.
7,046,949 B2 5/2006 Tomita et al.
7,054,570 B2 5/2006 Kishi et al.
7,065,313 B2 6/2006 Matsumoto et al.
7,076,191 B2 7/2006 Muramatsu et al.
7,085,522 B2 8/2006 Muramatsu et al.
7,088,945 B2 8/2006 Matsumoto et al.
7,103,305 B2 9/2006 Koike et al.
7,116,923 B2 10/2006 Kishi et al.
7,116,928 B2 10/2006 Muramatsu et al.
7,127,198 B2 10/2006 Muramatsu et al.
7,127,202 B2 10/2006 Fujita et al.
7,130,555 B2 10/2006 Kishi et al.
7,130,558 B2 10/2006 Matsumoto et al.
7,139,520 B2 11/2006 Echigo et al.
7,177,580 B2 2/2007 Nakafuji et al.
7,197,269 B2 3/2007 Omata et al.
7,209,675 B2 4/2007 Matsusaka et al.
7,209,689 B2 4/2007 Matsumoto et al.
7,212,758 B2 5/2007 Kishi et al.
7,212,759 B2 5/2007 Kishi et a
7,218,880 B2 5/2007 Yanagisawa et al.
7,221,891 B2 5/2007 Matsumoto et al.
7,233,762 B2 6/2007 Kunii et al.
7,239,821 B2 7/2007 Matsusaka et al.
7,245,853 B2 7/2007 Muramatsu et al.
7,254,360 B2 8/2007 Tomita
7,254,362 B2 8/2007 Kikuchi et al.
7,257,348 B2 8/2007 Matsumoto et al.
7,269,384 B2 9/2007 Someya et al.
7,277,664 B2 10/2007 Katsuyama et al.
7,277,665 B2 10/2007 Terazawa et al.
7,289,748 B2 10/2007 Yanagisawa et al.
7,295,795 B2 11/2007 Suzuki et al.
7,299,003 B2 11/2007 Kurotaka et al.
7,308,216 B2 12/2007 Kishi et al.
7,309,553 B2 12/2007 Tomita et al.
7,313,336 B2 12/2007 Kadota et al.
7,333,743 B2 2/2008 Kishi et al.
7,333,760 B2 2/2008 Baba et al.
7,343,113 B2 3/2008 Matsusaka et al.
7,346,286 B2 3/2008 Matsumoto et al.
7,346,299 B2 3/2008 Muramatsu et al.
7,352,987 B2 4/2008 Iwata et al.
7,356,270 B2 4/2008 Matsusaka et al.
7,356,288 B2 4/2008 Iwata et al.
7,356,290 B2 4/2008 Matsumoto et al.
7,356,298 B2 4/2008 Tomita et al.
7,359,666 B2 4/2008 Takashi et al.
7,366,432 B2 4/2008 Kishi et al.
7,369,803 B2 5/2008 Echigo et al.
7,373,094 B2 5/2008 Kishi et al.
7,406,278 B2 7/2008 Katsuyama et al.
7,433,641 B2 10/2008 Kikuchi et al.
7,444,107 B2 10/2008 Takeuchi et al.
7,450,891 B2 11/2008 Muramatsu et al.
7,480,473 B2 1/2009 Matsuura et al.
7,496,309 B2 2/2009 Matsusaka et al.
7,509,079 B2 3/2009 Muramatsu et al.
7,512,364 B2 3/2009 Muramatsu et al.
7,515,845 B2 4/2009 Kishi et al.
7,526,242 B2 4/2009 Takagaki et al.
7,536,139 B2 5/2009 Katsuyama et al.
7,542,697 B2 6/2009 Matsumoto et al.
7,542,703 B2 6/2009 Kasahara et al.
7,551,869 B2 6/2009 Kishi et al.
7,565,087 B2 7/2009 Matsusaka et al.
7,570,911 B2 8/2009 Nakafuji et al.
7,583,922 B2 9/2009 Takashi et al.
7,590,376 B2 9/2009 Tomita et al.
7,593,674 B2 9/2009 Matsumoto et al.
7,603,049 B2 10/2009 Kishi et al.
7,603,054 B2 10/2009 Katsuyama et al.
7,609,988 B2 10/2009 Kishi et al.
7,664,410 B2 2/2010 Takagi
7,738,827 B2 6/2010 Someya et al.
7,778,577 B2 8/2010 Muramatsu et al.
7,796,914 B2 9/2010 Matsumoto et al.
7,809,322 B2 10/2010 Takeuchi et al.
7,885,569 B2 2/2011 Kishi et al.
7,894,753 B2 2/2011 Kasahara et al.
7,904,006 B2 3/2011 Muramatsu
7,912,392 B2 3/2011 Yoshinaga et al.
7,917,055 B2 3/2011 Katsuyama et al.
7,925,177 B2 4/2011 Ishii et al.
7,957,663 B2 6/2011 Kishi et al.
8,073,352 B2 12/2011 Kunii et al.
8,131,198 B2 3/2012 Ishii et al.
8,478,181 B2 * 7/2013 Ichikawa ..... 399/341
2001/0006583 A1 7/2001 Tomita
2001/0052526 A1 12/2001 Kasahara et al.
2002/0006566 A1 1/2002 Tomita
2002/0009310 A1 1/2002 Kabumoto et al.
2002/0009315 A1 1/2002 Tomita
2002/0025195 A1 2/2002 Iwata et al.
2002/0025196 A1 2/2002 Matsumoto et al.
2002/0031363 A1 3/2002 Tomita et al.
2002/0039502 A1 4/2002 Matsumoto et al.
2002/0106221 A1 8/2002 Muramatsu et al.
2002/0164178 A1 11/2002 Muramatsu et al.
2003/0012586 A1 1/2003 Iwata et al.
2003/0031947 A1 2/2003 Tomita
2003/0039911 A1 2/2003 Tomita et al.
2003/0059224 A1 3/2003 Tomita et al.
2003/0081969 A1 5/2003 Muramatsu et al.
2003/0086722 A1 5/2003 Nakazato et al.
2003/0165348 A1 9/2003 Amita et al.
2003/0198487 A1 10/2003 Yanagisawa et al.
2003/0207194 A1 11/2003 Tomita
2003/0224277 A1 12/2003 Tomita
2003/0235435 A1 12/2003 Muramatsu et al.
2003/0235436 A1 12/2003 Kasahara et al.
2003/0235442 A1 12/2003 Suzuki et al.
2004/0013963 A1 1/2004 Muramatsu et al.
2004/0033088 A1 2/2004 Muramatsu et al.
2004/0033431 A1 2/2004 Tomita
2004/0037595 A1 2/2004 Takashi et al.
2004/0076456 A1 4/2004 Tani et al.
2004/0091287 A1 5/2004 Matsumoto et al.
2004/0091295 A1 5/2004 Nakamura et al.

(56) References Cited

U.S. PATENT DOCUMENTS

| | | | |
|---|---|---|---|
| 2004/0101332 | A1 | 5/2004 | Sohmiya et al. |
| 2004/0131392 | A1 | 7/2004 | Matsumoto et al. |
| 2004/0131398 | A1 | 7/2004 | Omata et al. |
| 2004/0197119 | A1 | 10/2004 | Matsumoto et al. |
| 2004/0245241 | A1 | 12/2004 | Kishi et al. |
| 2004/0247332 | A1 | 12/2004 | Kishi et al. |
| 2004/0247334 | A1 | 12/2004 | Kishi et al. |
| 2004/0247343 | A1 | 12/2004 | Matsumoto et al. |
| 2004/0258426 | A1 | 12/2004 | Kishi et al. |
| 2005/0025527 | A1 | 2/2005 | Matsumoto et al. |
| 2005/0025534 | A1 | 2/2005 | Fujita et al. |
| 2005/0025537 | A1 | 2/2005 | Echigo et al. |
| 2005/0089347 | A1 | 4/2005 | Muramatsu et al. |
| 2005/0095037 | A1 | 5/2005 | Koike et al. |
| 2005/0117943 | A1 | 6/2005 | Nakafuji et al. |
| 2005/0139584 | A1 | 6/2005 | Kishi et al. |
| 2005/0152721 | A1 | 7/2005 | Kikuchi et al. |
| 2005/0158075 | A1 | 7/2005 | Echigo et al. |
| 2005/0158083 | A1 | 7/2005 | Muramatsu et al. |
| 2005/0163537 | A1 | 7/2005 | Muramatsu et al. |
| 2005/0169673 | A1 | 8/2005 | Matsumoto et al. |
| 2005/0175368 | A1 | 8/2005 | Matsusaka et al. |
| 2005/0175370 | A1 | 8/2005 | Matsusaka et al. |
| 2005/0180782 | A1 | 8/2005 | Matsumoto et al. |
| 2005/0191078 | A1 | 9/2005 | Kishi et al. |
| 2005/0201783 | A1 | 9/2005 | Kurotaka et al. |
| 2005/0207801 | A1 | 9/2005 | Kunii et al. |
| 2005/0232664 | A1 | 10/2005 | Tomita |
| 2005/0265759 | A1 | 12/2005 | Takeuchi et al. |
| 2005/0281592 | A1 | 12/2005 | Muramatsu et al. |
| 2005/0286920 | A1 | 12/2005 | Baba et al. |
| 2006/0008281 | A1 | 1/2006 | Matsumoto et al. |
| 2006/0008302 | A1 | 1/2006 | Someya et al. |
| 2006/0013604 | A1 | 1/2006 | Kadota et al. |
| 2006/0013624 | A1 | 1/2006 | Kurotaka et al. |
| 2006/0019082 | A1 | 1/2006 | Kikuchi et al. |
| 2006/0024095 | A1 | 2/2006 | Suzuki et al. |
| 2006/0029411 | A1 | 2/2006 | Ishii et al. |
| 2006/0039713 | A1 | 2/2006 | Kishi et al. |
| 2006/0045571 | A1 | 3/2006 | Matsuura et al. |
| 2006/0051111 | A1 | 3/2006 | Kishi et al. |
| 2006/0051112 | A1 | 3/2006 | Matsusaka et al. |
| 2006/0051113 | A1 | 3/2006 | Kishi et al. |
| 2006/0051119 | A1 | 3/2006 | Kishi et al. |
| 2006/0051120 | A1 | 3/2006 | Kishi et al. |
| 2006/0051121 | A1 | 3/2006 | Matsusaka et al. |
| 2006/0088349 | A1 | 4/2006 | Someya et al. |
| 2006/0099006 | A1 | 5/2006 | Yanagisawa et al. |
| 2006/0120776 | A1 | 6/2006 | Takashi et al. |
| 2006/0127118 | A1 | 6/2006 | Kishi et al. |
| 2006/0140679 | A1 | 6/2006 | Iwata et al. |
| 2006/0140689 | A1 | 6/2006 | Echigo et al. |
| 2006/0159477 | A1 | 7/2006 | Tomita et al. |
| 2006/0171749 | A1 | 8/2006 | Tomita et al. |
| 2006/0182460 | A1 | 8/2006 | Kishi et al. |
| 2007/0009289 | A1 | 1/2007 | Muramatsu et al. |
| 2007/0014600 | A1 | 1/2007 | Ishii et al. |
| 2007/0031159 | A1 | 2/2007 | Kishi et al. |
| 2007/0065188 | A1 | 3/2007 | Takagaki et al. |
| 2007/0092303 | A1 | 4/2007 | Katsuyama et al. |
| 2007/0104520 | A1 | 5/2007 | Nakafuji et al. |
| 2007/0110480 | A1 | 5/2007 | Matsumoto et al. |
| 2007/0122207 | A1 | 5/2007 | Matsumoto et al. |
| 2007/0189813 | A1 | 8/2007 | Matsumoto et al. |
| 2007/0212090 | A1 | 9/2007 | Matsusaka et al. |
| 2008/0038019 | A1 | 2/2008 | Kasahara et al. |
| 2008/0069596 | A1 | 3/2008 | Katsuyama et al. |
| 2008/0108501 | A1 | 5/2008 | Fujimoto et al. |
| 2008/0145088 | A1 | 6/2008 | Matsusaka et al. |
| 2008/0152380 | A1 | 6/2008 | Matsumoto et al. |
| 2008/0219683 | A1 | 9/2008 | Muramatsu |
| 2008/0219716 | A1 | 9/2008 | Takashi et al. |
| 2008/0253789 | A1 | 10/2008 | Yoshinaga et al. |
| 2009/0041520 | A1 | 2/2009 | Takeuchi et al. |
| 2009/0080945 | A1 | 3/2009 | Muramatsu et al. |
| 2009/0123172 | A1 | 5/2009 | Kishi et al. |
| 2009/0129811 | A1 | 5/2009 | Katsuyama et al. |
| 2009/0154967 | A1 | 6/2009 | Tomita |
| 2009/0169232 | A1 | 7/2009 | Kunii et al. |
| 2009/0185832 | A1 | 7/2009 | Muramatsu et al. |
| 2009/0317113 | A1 | 12/2009 | Kishi et al. |
| 2009/0324298 | A1 | 12/2009 | Katsuyama et al. |
| 2010/0008706 | A1 | 1/2010 | Sugiura et al. |
| 2010/0232818 | A1 | 9/2010 | Kunii |
| 2010/0239337 | A1 | 9/2010 | Muramatsu et al. |
| 2010/0310289 | A1 | 12/2010 | Someya et al. |
| 2011/0064493 | A1 | 3/2011 | Muramatsu et al. |
| 2011/0064494 | A1 | 3/2011 | Amita et al. |
| 2011/0085815 | A1 | 4/2011 | Kishi et al. |
| 2011/0176822 | A1 | 7/2011 | Ishii et al. |
| 2011/0188911 | A1 | 8/2011 | Kunii et al. |
| 2012/0008153 | A1 | 1/2012 | Kunii et al. |
| 2012/0201579 | A1 | 8/2012 | Kunii et al. |
| 2012/0224898 | A1 | 9/2012 | Amita et al. |

FOREIGN PATENT DOCUMENTS

| | | | | |
|---|---|---|---|---|
| JP | 05072926 | A | * | 3/1993 |
| JP | 05165350 | A | * | 7/1993 |
| JP | 2004258535 | A | | 9/2004 |
| JP | 2004325934 | A | | 11/2004 |
| JP | 2005/0226655 | A1 | | 10/2005 |
| JP | 2006243465 | A | | 9/2006 |
| JP | 2006250971 | A | | 9/2006 |
| JP | 2006337718 | A | | 12/2006 |
| JP | 2007078787 | A | * | 3/2007 |
| JP | 2007078787 | A | | 3/2007 |
| JP | 2007078917 | A | | 3/2007 |
| JP | 2010127996 | A | | 6/2010 |

* cited by examiner

GLOSSING DEVICE, FIXING DEVICE, AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-137462, filed on Jun. 21, 2011, the entire disclosure of which is hereby incorporated by reference herein.

BACKGROUND OF THE INVENTION

1. Technical Field

The present invention relates to a glossing device, a fixing device, and an image forming apparatus incorporating the same, and more particularly, to a fixing device that processes a toner image with heat and pressure on a recording medium for imparting gloss, and an electrophotographic image forming apparatus, such as a photocopier, facsimile machine, printer, plotter, or multifunctional machine incorporating several of these features, which incorporates such a fixing device with a glossing capability.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium by melting and setting the toner with heat and pressure.

Modern image forming apparatuses accommodate a wide range of printing applications with different levels of image quality, using various types of recording media. In particular, printing of photographs and computer-generated images, which typically contain a wide, complete range of visible colors, necessitates a higher level of image quality and uniformity of image gloss than is required for conventional monochrome image formation.

Various techniques have been proposed to meet a growing demand for printers with high-gloss, high-quality imaging performance. Some such techniques employ a special, transparent toner, called "clear toner", for creating a transparent glossy effect on those areas of a recording medium where no color toner is deposited; others address duplex printing with a uniform, glossy finish on both sides of a recording medium. Among these, several techniques are directed to development of a more sophisticated fixing process.

Structurally, a fixing device with a glossing capability may be constructed of an endless rotary belt on which a recording medium is conveyed while subjected to heat and pressure. The endless belt is looped for rotation around multiple parallel rollers, including a heated roller and a separator roller, with a pressure roller disposed opposite the heated roller via the belt to form a fixing nip therebetween. During operation, a recording medium is conveyed through the fixing nip to process a toner image under heat and pressure. After passage through the fixing nip, the recording medium closely contacts the belt as the belt moves from the heated roller toward the separator roller, and separates from the belt as the belt passes around the separator roller.

For example, a belt-based fixing system has been proposed which includes a thermal pre-fixing unit and a gloss adjustment unit. The pre-fixing unit consists of a pair of opposed heated rollers pressing against each other to form a pre-fixing nip therebetween. The gloss adjustment unit consists of a smooth, endless rotary belt entrained around a pair of motor-driven and idler rollers, with a pressure roller opposite the motor-driven roller to form a main fixing nip therebetween.

In this fixing system, a recording medium is initially passed through the pre-fixing unit, which renders an unfixed powder toner image into a semi-fluid, soft pliable state. After pre-fixing, the recording medium is conveyed to the gloss adjustment unit with the toner image pressed against the endless belt, which imparts gloss to the toner image as the molten toner gradually cools and solidifies while conforming to the smooth surface of the belt. The gloss adjustment unit adjusts glossiness of the toner image by adjusting a distance or duration during which the toner image travels on the belt downstream from the fixing nip.

To date, belt-based fixing devices are designed with a belt cooler for cooling an endless rotary belt during conveyance of a recording medium downstream from a fixing nip, so as to provide uniform cooling and proper separation of the recording medium from the belt after fixing and glossing a toner image thereon.

For example, one known image heating device employs a non-contact belt cooler, such as a cooling fan, disposed apart from an endless rotary belt for cooling the belt by air flow or forced convection.

In this image heating device, the endless rotary belt is entrained around fixing and separator rollers as well as a heater interposed between the rollers, with a backup, pressure roller disposed opposite the heater via the belt to form a nip therebetween. The belt assembly also includes a pair of electrostatically charged rollers disposed opposite each other via the belt downstream from the nip to impart electrostatic charge to the belt and a recording medium passing therethrough, which prevents premature separation of the recording medium from the belt. The cooling fan is disposed downstream from the heater to cool the belt and the recording medium after passing through the nip.

Another fixing device is known employing a heat sink, instead of a non-contact belt cooler, disposed in contact with an endless rotary belt for cooling the belt through direct contact with the heat absorbing surface.

In this fixing device, the endless rotary belt is entrained around multiple rollers, including a heated fixing roller and a separator roller, with a pressure roller disposed opposite the fixing roller via the belt to form a fixing nip therebetween. The belt assembly also includes an additional, heated pre-fixing roller disposed inside the loop of the belt upstream from the fixing nip, with a backup roller disposed opposite the pre-fixing roller to form a pre-fixing nip therebetween. The heat sink is provided inside the loop of the belt between the fixing roller and the separator roller, with an outer surface of the heat sink parallel to, and in contact with, the belt surface to cool the belt after heating through the pre-fixing and fixing nips.

Still another fixing device is known employing a cooling fan in combination with a cooler backup roller pressing an endless rotary belt against the fan to increase efficiency in cooling the belt.

In this fixing device, the endless rotary belt is entrained around multiple rollers, including a heated fixing roller and a separator roller, with a pressure roller disposed opposite the fixing roller via the belt to form a fixing nip therebetween. The cooling fan is provided inside the loop of the fixing belt between the fixing roller and the separator roller, with a cooler backup roller disposed opposite the cooling fan via the fixing belt to press the belt against the cooling fan from outside the loop of the fixing belt.

Yet still another fixing device is known employing a pair of cooling devices disposed opposite each other to increase cooling efficiency while allowing for efficient media conveyance through the fixing process.

This fixing device includes a pair of opposed belt assemblies, each of which includes an endless rotary belt entrained around a heated roller and a separator roller, with the two heated rollers of the opposed sides pressing against each other via the belts to form a first fixing nip therebetween, and the two separator rollers of the opposed sides pressing against each other via the belts to form a second fixing nip therebetween. The pair of cooling devices is provided, one for each of the belt assemblies, each cooling device located inside the loop of the fixing belt between the heated roller and the separator roller.

Although generally successful for their intended purposes, the approaches depicted above have several drawbacks.

For example, the image heating device using a cooling fan has a limitation in that it cannot accommodate high processing speeds as required in today's high-speed printers, insofar as a non-contact cooler employing air flow or convection cannot remove heat as efficiently and immediately as a contact cooler.

Also, the fixing device using a heat sink is not satisfactory in terms of cooling efficiency because deploying the heat sink and the belt parallel to each other translates into a relatively loose contact between the heat sink and the belt, resulting in insufficient heat transfer from the belt to the heat sink.

Further, the fixing device using a cooling fan with a cooler backup roller is not practical where pressing the belt against the cooling fan adversely affects durability of the belt assembly. That is, striking against an edge of the cooling device can strain the belt in its longitudinal, conveyance direction, while sliding against the cooling device can cause increased wear and tear on the belt surface. Moreover, use of the cooler backup roller entails a risk of damaging the resulting print where the backup roller slides against the printed, bottom face of recording medium during duplex printing.

Still further, the fixing device using a pair of cooling devices is not practical where combined use of the pair of opposed belt assemblies may complicate control of the rotary belts for maintaining synchronized movement of the belts with each other, the absence of which would result in image defects, such as smearing or shifting, of the resulting print.

SUMMARY OF THE INVENTION

Exemplary aspects of the present invention are put forward in view of the above-described circumstances, and provide a novel fixing device for processing a toner image on a recording medium.

In one exemplary embodiment, the fixing device includes a first roller, a second roller, an endless rotary belt, a third roller, a heater, a belt cooler, and an upstream guide member. The second roller is disposed parallel to the first roller. The endless rotary belt is looped for rotation around the first and second rollers in a longitudinal, conveyance direction of the belt. The third roller is disposed opposite the first roller via the belt. The heater is positioned adjacent to the belt to heat the belt. The first and third rollers press against each other via the belt to form a nip therebetween through which the recording medium is conveyed to process a toner image under heat and pressure. The recording medium after passage through the nip remains in contact with the belt as the belt moves from the first roller toward the second roller, and separates from the belt as the belt passes around the second roller. The belt cooler is disposed inside the loop of the belt downstream from the first roller and upstream from the second roller for cooling the belt. The belt cooler has a convex contact surface extending between upstream and downstream ends thereof in the conveyance direction of the belt to absorb heat from the belt. The upstream guide member is disposed inside the loop of the belt upstream from the contact surface to guide the belt during rotation such that the belt comes into contact with the contact surface without contacting the upstream end of the belt cooler.

Other exemplary aspects of the present invention are put forward in view of the above-described circumstances, and provide a fixing device incorporating a glossing device.

Still other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
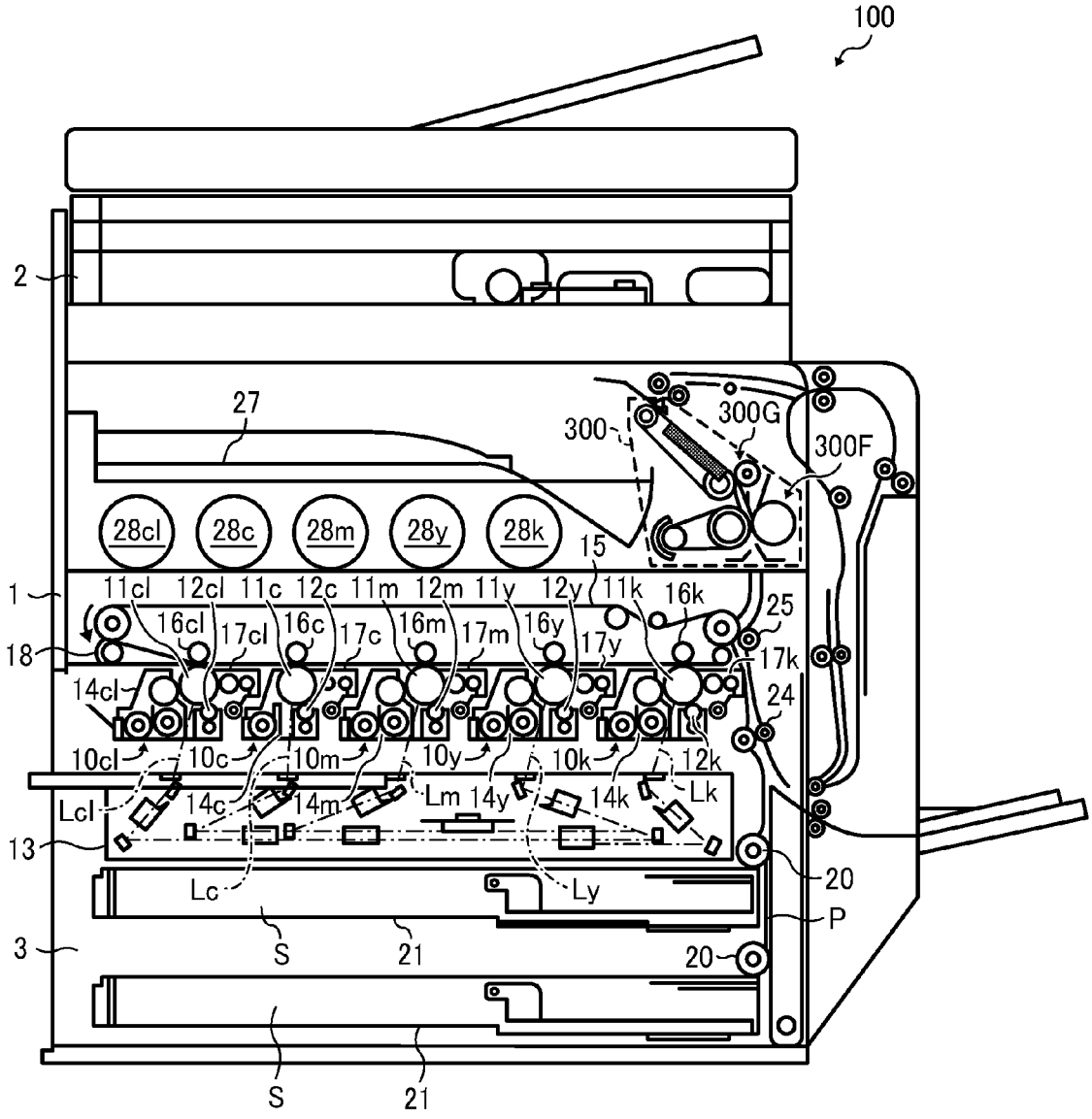
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating a fixing device 300 according to one or more embodiments of this patent specification.

As shown in FIG. 1, the image forming apparatus 100 in the present embodiment includes a printing unit 1 located at a central part of the apparatus body for printing a toner image on a recording medium such as a sheet S of paper, above which may be deployed an image scanning unit 2 for capturing image information from a user-supplied original document.

In the image forming apparatus 100, the printing unit 1 comprises a tandem color printer including five imaging stations 10*c*1, 10*c*, 10*m*, 10*y*, 10*k* arranged in series generally horizontally below an intermediate transfer belt 15 and above an exposure unit 13, which together form an electrophotographic mechanism to form an image with toner particles on a recording sheet S for subsequent processing through the fixing device 300 located adjacent to the intermediate transfer belt 15.

The imaging stations (indicated collectively by the reference numeral 10) are of a substantially identical configuration, each having a drum-shaped photoconductor 11 surrounded by a charging device 12 for charging the photoconductor surface to generate a latent image, a development device 14 for developing the latent image into a visible form using toner, and a cleaning device 17 for cleaning the photoconductive surface of residual toner, which work in cooperation to form a toner image of a particular color, as designated by the suffixes "c" for cyan, "m" for magenta, "y" for yellow, "k" for black, and "cl" for a clear or transparent color. The imaging stations 10*c*1, 10*c*, 10*m*, 10*y*, 10*k* are supplied with toner from toner bottles 28*c*1, 28*c*, 28*m*, 28*y*, and 28*k*, respectively, each of which is connected with the development device 14 through a suitable piping or conduit for transporting toner.

The intermediate transfer belt 15 is entrained around multiple belt support rollers and primary transfer rollers 16*c*1, 16*c*, 16*m*, 16*y*, and 16*k* for rotation counterclockwise in the drawing, passing through five primary transfer nips defined between the primary transfer rollers 16 and the corresponding photoconductive drums 11, and then through a secondary transfer nip defined between a belt support roller and the secondary transfer roller 25, followed by meeting a belt cleaner 18 downstream from the secondary transfer nip.

The fixing device 300 includes a fixing unit 300F for fixing a toner image in place on a recording sheet S, and a glossing unit 300G for imparting gloss to the toner image after fixing. Each of the fixing and glossing units 300F and 300G includes a pair of opposed rotary members, at least one of which is heated, and at least one of which is pressed against the other one, to form a heated area of contact called a nip, through which the toner image is processed with heat and pressure on the recording sheet S. Specific configurations of the fixing device 300 will be described later in more detail with reference to FIG. 2 and subsequent drawings.

Below the printing unit 1 is a media conveyance unit 3 for supplying recording sheets S to the printing unit 1. The media conveyance unit 3 includes one or more input sheet trays 21 each accommodating a stack of recording sheets S for feeding with a feed roller 20, as well as various conveyor and guide members, such as a pair of registration rollers 24, together defining a sheet conveyance path P along which a recording sheet S advances upward from the input tray 21 to pass through the secondary transfer nip and then through the fixing device 300 to finally reach an in-body output sheet tray 27.

During operation, the printing unit 1 activates the imaging stations 10 to form a toner image on an outer surface of the intermediate transfer belt 15 according to image data supplied from a data source, such as from the image scanning unit 2 in case of photocopying, from a host computer in case of printing, or from a remote location via a phone line in case of facsimile.

Specifically, upon activation, each imaging station 10 rotates the photoconductor drum 11 counterclockwise in the drawing to forward its outer, photoconductive surface to a series of electrophotographic processes, including charging, exposure, development, transfer, and cleaning, in one rotation of the photoconductor drum 11.

First, the photoconductive surface is uniformly charged to a particular polarity by the charging device 12 and subsequently exposed to a modulated laser beam L emitted from the exposure unit 13 to which electronic signals are supplied from a data source. The laser exposure selectively dissipates the charge on the photoconductive surface to form an electrostatic latent image thereon according to image data representing a particular primary color. Then, the latent image enters the development device 14 which renders the incoming image visible using toner. The toner image thus obtained is forwarded to the primary transfer nip between the intermediate transfer belt 15 and the primary transfer roller 16.

At the primary transfer nip, the primary transfer roller 16 is supplied with a bias voltage of a polarity opposite that of the toner on the photoconductor drum 11. This electrostatically transfers the toner image from the photoconductive surface to an outer surface of the belt 15, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 15.

After primary transfer, the photoconductor 11 enters the cleaning device 17 to remove residual toner from the photoconductive surface for preparation for a subsequent imaging cycle. At the same time, the intermediate transfer belt 15 forwards the multicolor image to the secondary transfer nip between the belt support roller and the secondary transfer roller 25.

Meanwhile, in the media conveyance unit 3, the conveyor rollers introduce a recording sheet S from the input sheet tray 21 toward the pair of registration rollers 24 being rotated. Upon receiving the fed sheet S, the registration rollers 24 stop rotation to hold the incoming sheet S therebetween, and then advance it in sync with the movement of the intermediate transfer belt 15 to the secondary transfer nip. At the secondary transfer nip, the multicolor image is transferred from the belt 15 to the recording sheet S.

After secondary transfer, the intermediate transfer belt 15 advances to the belt cleaner 18, which removes residual toner from the belt surface to prepare it for a subsequent imaging cycle. At the same time, the recording sheet S bearing the powder toner image thereon is introduced into the fixing device 300, at which the fixing unit 300F fixes the multicolor image in place on the recording sheet S with heat and pressure, followed by the glossing unit 300G processing the fixed toner image with heat and pressure to impart gloss to the resulting print. Thereafter, the recording sheet S is ejected to the output tray 27 for stacking inside the apparatus body, which completes one operational cycle of the image forming apparatus 100.

Although the embodiment above is directed to an operation in which printing is performed using all the five imaging stations 10 to form a full-color image with a glossy, textured surface, the image forming apparatus 100 may selectively operate in multiple modes of operation, such as a monochrome mode and a multi- or full-color mode, with a specific combination of imaging stations 10*c*l, 10*c*, 10*m*, 10*y*, 10*k* activated to create an image in a particular color or tone as desired.

Also, the image forming apparatus 100 may selectively operate in a glossing mode in which a toner image is finished with an enhanced gloss, or in a normal fixing mode in which a toner image is processed without gloss finishing, as specified by a user, or depending on the type of recording medium S used in a given print job. In such cases, the glossing unit 300G is configured to change relative positions of the rotary members forming a nip therebetween, which is selectively established during operation in the normal fixing mode and de-established during operation in the glossing mode.

Figure 2:
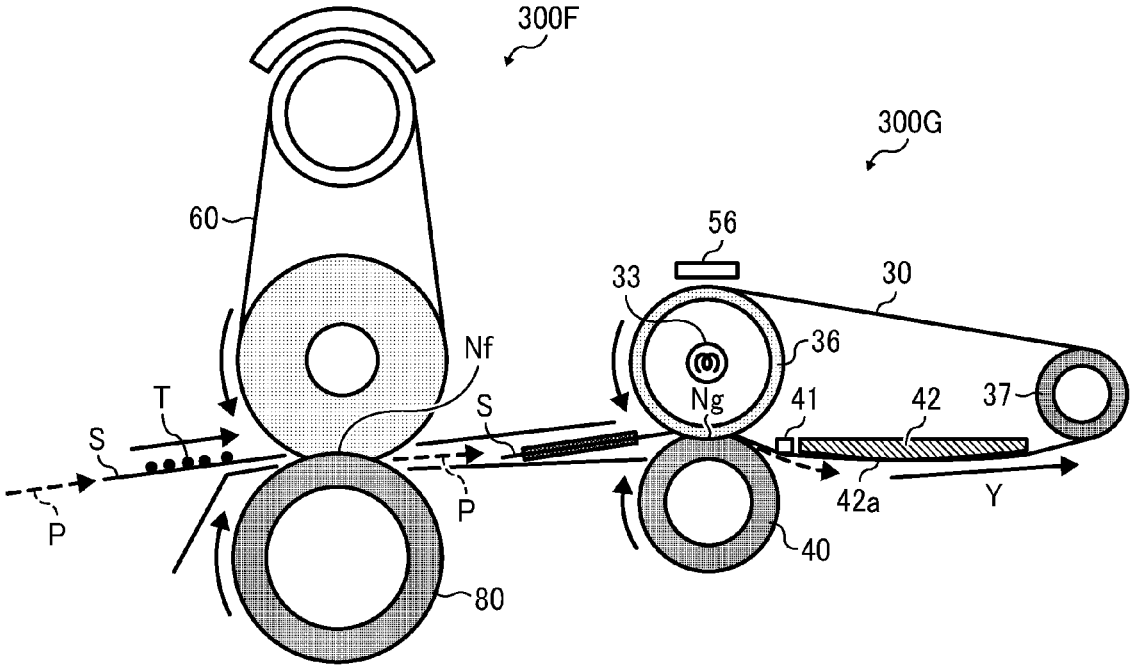
FIG. 2 is an end-on, axial view of the fixing device including a glossing unit, shown with a guide member according to a first embodiment of this patent specification.

FIG. 2 is an end-on, axial view of the fixing device 300 according to one or more embodiments of this patent specification.

As shown in FIG. 2, the fixing device 300 includes a fixing unit 300F to fix a toner image T in place on a recording sheet S conveyed along a sheet conveyance path P, and a glossing unit 300G disposed downstream from the fixing unit 300F along the sheet conveyance path P to process the toner image T with heat and pressure, so as to impart gloss to the resulting print on the recording sheet S.

The fixing unit 300F includes a pair of rotary fixing members 60 and 80, at least one of which is heated, and at least one of which is pressed against the other one to form a fixing nip Nf therebetween. In the present embodiment, for example, the fixing unit 300F includes a heated, endless fuser belt 60 paired with a pressure roller 80 pressed against the fuser belt 60. Any suitable type of heating mechanism may be employed to heat the fuser belt 60, such as, for example, a radiant, halogen lamp or an electromagnetic induction heater, depending on specific configurations of the fixing process.

The glossing unit 300G includes a first, heat roller 36; a second, stripper roller 37 disposed parallel to the first roller 36; an endless rotary belt 30 looped for rotation around the first and second rollers 36 and 37 in a longitudinal, conveyance direction Y of the glossing belt 30; a third, pressure roller 40 disposed opposite the first roller 36 via the glossing belt 30; and a heater 33 disposed in the first roller 36 to heat the glossing belt 30.

The first and third rollers 36 and 40 press against each other via the glossing belt 30 to form a glossing nip Ng therebetween through which a recording medium S is conveyed to process a toner image T under heat and pressure. The recording medium S after passage through the glossing nip Ng remains in contact with the glossing belt 30 as the belt 40 moves from the first roller 36 toward the second roller 37, and separates from the glossing belt 30 as the glossing belt 30 passes around the second roller 37.

The glossing unit 300G also includes a belt cooler 42 inside the loop of the glossing belt 30 downstream from the first roller 36 and upstream from the second roller 37 for cooling the glossing belt 30. The belt cooler 42 has a curved, convex contact surface 42*a* extending between upstream and downstream ends thereof in the conveyance direction Y of the belt 30 to absorb heat from the glossing belt 30, with its curvature dimensioned to keep the recording sheet S in contact with the glossing belt 30 during conveyance along the belt cooler 42.

As used herein, the terms "upstream" and "downstream" are used to describe the geometric configuration of the belt cooler 42 in the longitudinal, conveyance direction Y in which the glossing belt 30 moves from the first roller 36 toward the second roller 37 during operation of the fixing device 300. In particular, when referring to the two opposed ends of the belt cooler 42 in the conveyance direction Y of the glossing belt 30, the term "upstream end" describes that end of the belt cooler 42 closest to the first roller 36, and the term "downstream end" describes that end of the belt cooler 42 closest to the second roller 37. Unless otherwise specified, those directional terms also apply to describe positioning of a surrounding structure of the belt cooler 42 in the conveyance direction Y of the glossing belt 30.

Optionally, the glossing unit 300G may be equipped with a non-contact temperature sensor or thermometer 56 adjacent to the heat roller 36 outside the loop of the glossing belt 30 and on the side of the heat roller 36 away from the pressure roller 40 to measure temperature at an outer surface of the glossing belt 30. A controller, such as a central processing unit (CPU) with associated memory devices, may be provided to optimize operation of the heater 33 according to readings of the thermometer 56 to maintain the belt temperature at a desired operational temperature.

During operation, after image formation through an electrophotographic imaging unit according to a print request in a manner as described above with reference to FIG. 1, a recording sheet S bearing an unfixed toner image T thereon enters the fixing unit 300F.

In the fixing unit 300F, the incoming sheet S passes through the fixing nip Nf, which melts and fuses toner with heat from the fuser belt 60 and pressure from the pressure roller 80, resulting in the toner image T fixed in place on the recording sheet S. After fixing, the recording sheet S enters the glossing unit 300G.

In the glossing unit 300G, the incoming sheet S initially passes through the glossing nip Ng along the rotating belt 30, which re-melts the once-fixed toner image T with heat from the heat roller 36 and pressure between the opposed rollers 36 and 40. The recording sheet S after passing through the glossing nip Ng is conveyed with its printed surface contacting the belt surface, as the glossing belt 30 moves from the heat roller 36 toward the stripper roller 37 in the longitudinal, conveyance direction Y of the glossing belt 30.

The inner, back side of the glossing belt 30 traveling from the first roller 36 toward the second roller 37 is cooled by the belt cooler 42 from inside the loop of the glossing belt 30, which in turn cools the printed surface of the recording sheet S on the outer, front side of the glossing belt 30. As the recording sheet S cools, the re-molten toner T contacting the belt surface also cools and solidifies to assume a smooth, uniform surface in conformity with the smooth outer surface of the glossing belt 30, resulting in a smooth, glossy effect created on the printed surface of the recording sheet S.

After cooling downstream from the glossing nip Ng, the recording sheet S on the rotating belt 30 then meets the stripper roller 37, at which the curvature of the stripper roller 37 causes the sheet S to separate from the belt surface and finally exit the glossing unit 300G.

In the present embodiment, the first, heat roller 36 comprises a cylindrical body of thermally conductive material, such as aluminum, stainless steel, iron, or the like, approximately 30 mm to approximately 90 mm in diameter. An optional, coating layer of elastic material, such as silicone rubber or the like, approximately 0.5 mm to approximately 5 mm thick, may be provided on an outer surface of the heat roller 36 to create an increased area of contact between the opposed rollers 36 and 40 at the glossing nip Ng.

The second, stripper roller 37 comprises a cylindrical body of suitable material, such as iron, aluminum, stainless steel, or the like, approximately 10 mm to approximately 30 mm in diameter.

The endless glossing belt 30 comprises a looped flexible belt of heat-resistant resin or metal, such as polyimide, nickel, stainless steel, or the like, approximately 10 μm to approximately 200 μm in thickness, and approximately 80 mm to approximately 300 mm in diameter in its generally cylindrical configuration. An optional, coating layer of elastic material, such as silicone rubber or the like, approximately 5 μm to approximately 50 μm thick may be provided on the outer surface of the glossing belt 30 for allowing close, uniform contact with the printed surface of the recording sheet S conveyed on the glossing belt 30. Also, the outermost surface of the glossing belt 30 may be provided with a coating of release agent, such as silicone or fluorine resin, for providing ready separation of the recording sheet S from the glossing belt 30.

The third, pressure roller 40 comprises a cylindrical body approximately 30 mm to approximately 90 mm in diameter, consisting of a cylindrical core of suitable material, such as iron, aluminum, stainless steel, or the like, covered with an outer layer of elastic material, such as fluorine rubber, silicone rubber, or the like, approximately 1 mm to approximately 50 mm thick, deposited on the cylindrical core.

The pressure roller 40 is equipped with a suitable biasing mechanism formed, for example, of a rotary actuator connected to the roller rotational axis through a cam, which allows the pressure roller 40 to move relative to the glossing belt 30 and the heat roller 36, so as to adjust width and strength of the glossing nip Ng determined by relative positions of the rotational axes of the opposed rollers 36 and 40. The pressure roller 40 also has a suitable rotary driver motor connected to the roller rotational axis, which rotationally drives the roller 40 to in turn rotate the heat roller 36 as well as the glossing belt 30 and the stripper roller 37.

The heater 33 comprises any suitable heat source that generates an amount of heat sufficient to re-melt and re-fuse toner accommodated in the fixing device 300. In the present embodiment, for example, the heater 33 is a halogen heater disposed inside the heat roller 36 to radiate heat to an inner surface of the heat roller 36, from which heat is imparted to the glossing belt 30 entrained around the heated roller 36. Operation of the heater 33 is computer-controlled according to readings of the thermometer 56 so as to maintain the belt surface at a desired operational temperature.

The belt cooler 42 comprises a cooling jacket formed of metal with high thermal conductivity, such as aluminum, copper, stainless steel, or the like, which absorbs heat from a heated surface upon direct contact with the cooling jacket. The cooling jacket may be formed in any suitable configuration, such as a finned shape for air-cooling using a mechanical fan, or liquid or water-cooling using a heat pipe.

The convex contact surface 42*a* of the belt cooler 42 is configured to intrude into a common tangent plane between the first and second rollers 36 and 37 (i.e., an imaginary plane in which the belt would extend if entrained without the belt cooler between the first and second rollers). This configuration of the contact surface 42*a* allows the belt cooler 42 to stably press against the glossing belt 30, resulting in close, continuous contact between the cooler and belt surfaces to promote efficient transfer of heat from the glossing belt 30 to the belt cooler 42.

With still continued reference to FIG. 2, the glossing unit 300G is shown further including a guide member 41 disposed inside the loop of the glossing belt 30 upstream from the contact surface 42*a* of the belt cooler 42 to guide the glossing belt 30 during rotation such that the glossing belt 30 comes into contact with the contact surface 42*a* without contacting the upstream end of the belt cooler 42. Provision of the belt guide 41 prevents the glossing belt 30 from forcibly sliding against the upstream end of the belt cooler 42, which would otherwise damage or abrade the belt 30 under concentrated pressure particularly where two adjoining surfaces of the belt cooler 42 form a corner or edge at the upstream end. Protecting the belt against abrasion allows for longevity of the belt assembly, as well as stable, smooth movement of the belt free from slipping or skidding due to slippery particles arising from worn belt material.

A description is given below of specific configurations of the guide member 41 according to several embodiments of this patent specification, with reference to FIG. 3 and subsequent drawings.

Figure 3:
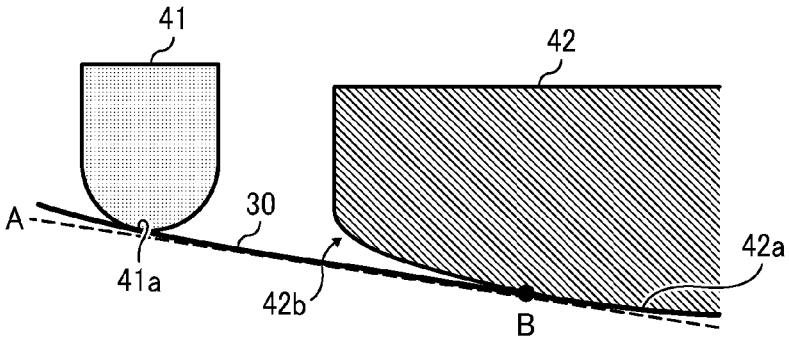
FIG. 3 is an enlarged view of the guide member of FIG. 2.

FIG. 3 is an enlarged view of the guide member 41 included in the glossing unit 300G according to a first embodiment of this patent specification. As shown in FIG. 3, the guide member 41 in the present embodiment comprises an elongated rib that extends longer than a width of the glossing belt 30, while defining an outwardly curved or rounded face where it touches the glossing belt 30. The guide member 41 is formed of a thermally resistant, anti-friction material, such as, for example, fluorine resin or the like, which exhibits a sufficiently low coefficient of friction relative to the belt material.

Specifically, the guide member 41 defines a convex guide surface 41*a* for guiding the glossing belt 30 therealong toward the convex contact surface 42*a* of the belt cooler 42. The guide surface 41*a* is positioned to coincide with an imaginary, tangential plane, indicated by broken line A, that is tangent to the convex contact surface 42*a* at a given point B downstream from the upstream end of the belt cooler 42.

In such a configuration, the guide member 41, with its guide surface 41*a* coincident with the tangential plane A of the convex contact surface 42*a*, directs the belt 30 at a stable, consistent angle with respect to the belt cooler 42, so as to maintain the glossing belt 30 apart from the upstream end of the belt cooler 42 even where there are variations in size and strength of the glossing nip Ng defined between the heat roller 36 and the pressure roller 40.

With continued reference to FIG. 3, in the present embodiment, the upstream end of the belt cooler 42 comprises a rounded edge 42*b* defining a curved surface with a curvature greater than that of the convex contact surface 42*a*. Provision of the rounded edge 42*b* enlarges a space or gap between the glossing belt 30 and the belt cooler 42, which reduces the risk of damaging the glossing belt 30 even where the glossing belt 30 accidentally touches the upstream end of the belt cooler 42.

The configuration of the upstream end of the belt cooler 42 may be other than that depicted in FIG. 3 so long as it provides adequate spacing between the glossing belt 30 and the belt cooler 42 for preventing damage to the glossing belt 30 at the upstream end of the belt cooler 42. For example, instead of a curved or rounded edge, the upstream end of the belt cooler may be formed into a chamfered edge defining an inclined surface that does not coincide with an imaginary plane tangent to the convex contact surface 42*a* at a given position downstream from the upstream end of the belt cooler 42.

Although in the present embodiment the glossing unit 300G is described as having only a single guide member 41 to guide the glossing belt 30, the belt assembly may be equipped with an additional, downstream guide member provided downstream from the contact surface 42*a* of the belt cooler 42 to guide the belt 30 such that the belt 30 separates from the contact surface 42*a* without touching the downstream end of the belt cooler 42.

Also, although the present embodiment describes the upstream end of the belt cooler 42 as having a chamfered configuration, the belt cooler 42 may have either one or both of its upstream and downstream ends comprising a rounded, chamfered, or otherwise shaped edge to provide adequate spacing between the glossing belt 30 and the belt cooler 42 for preventing damage to the glossing belt 30 at the upstream and downstream ends of the belt cooler 42.

Figure 4:
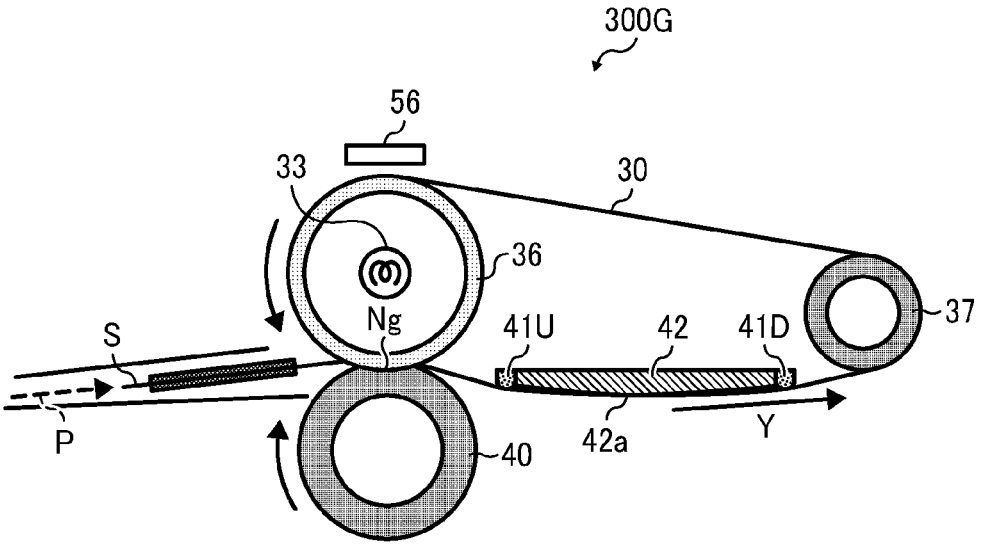
FIG. 4 is an end-on, axial view of the glossing unit, shown with a guide member according to a second embodiment of this patent specification.

FIG. 4 is an end-on, axial view of the glossing unit 300G according to a second embodiment of this patent specification. As shown in FIG. 4, the overall configuration of the present embodiment is similar to that depicted primarily with reference to FIG. 2, except that the glossing unit 300G includes, in place of a single upstream guide rib, a pair of upstream and downstream guide members 41U and 41D each of which comprises an integral part of the belt cooler 42, the former placed upstream and the latter placed downstream from the contact surface 42*a* of the belt cooler 42.

Figure 5:
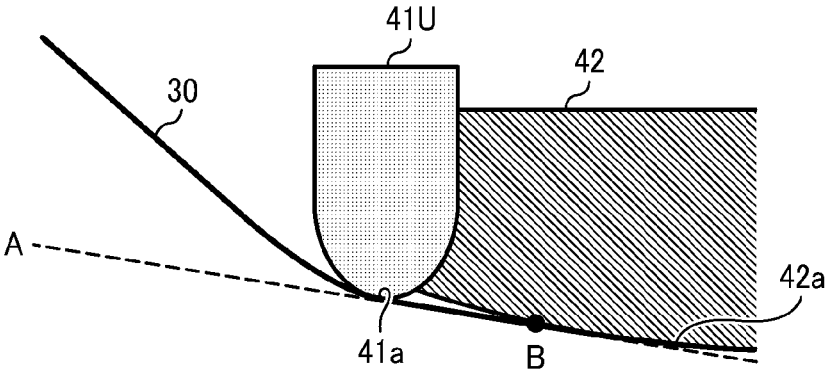
FIG. 5 is an enlarged view of the guide member of FIG. 4.

With additional reference to FIG. 5, which is an enlarged view of the guide member 41 included in the glossing unit 300G of FIG. 4, the upstream guide member 41U is shown comprising an elongated stationary rib formed integrally with, or otherwise connected to, the upstream end the belt cooler 42.

As is the case with the first embodiment, the upstream guide rib 41U defines a convex guide surface 41*a* for guiding the glossing belt 30 therealong toward the convex contact surface 42*a* of the belt cooler 42. The guide surface 41*a* is positioned to coincide with an imaginary, tangential plane A that is tangent to the convex contact surface 42*a* at a point B downstream from the upstream end of the belt cooler 42. The downstream guide rib 41D may be of a substantially identical configuration to that of the upstream guide rib 41U, of which a further description is omitted for brevity.

In such a configuration, the pair of guide members 41U and 41D works in a manner similar to that depicted in the foregoing embodiment. Compared to providing a separate guide rib, the guide member formed integrally with the belt cooler 42 allows for accurate, ready positioning of the guide surface 41*a* with respect to the cooler contact surface 42*a*. High accuracy in relative positions of the belt cooler 41 and the belt guide 42 results in uniform contact pressure between the belt 30 and the guide member 41, leading to more stable, smooth movement of the belt 30 free from slippage and localized damage to the belt surface.

Figure 6:
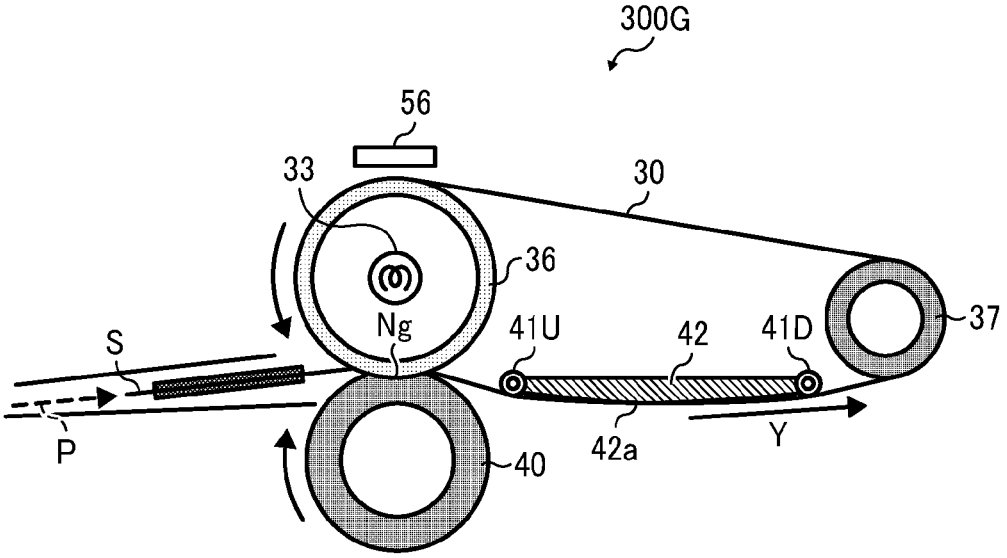
FIG. 6 is an end-on, axial view of the glossing unit, shown with a guide member according to a third embodiment of this patent specification.

FIG. 6 is an end-on, axial view of the glossing unit 300G according to a third embodiment of this patent specification. As shown in FIG. 6, the overall configuration of the present embodiment is similar to that depicted primarily with reference to FIG. 4, except that the glossing unit 300G includes, in place of a pair of stationary guide ribs, a pair of upstream and downstream guide members 41U and 41D each of which comprises a rotary body, the former placed upstream and the latter placed downstream from the contact surface 42*a* of the belt cooler 42.

Figure 7:
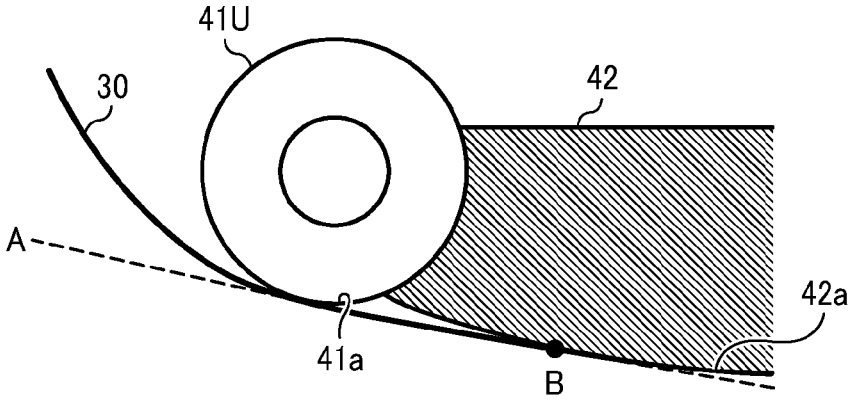
FIG. 7 is an enlarged view of the guide member of FIG. 6.

With additional reference to FIG. 7, which is an enlarged view of the guide member 41U included in the glossing unit 300G of FIG. 6, the upstream guide member 41U is shown comprising a cylindrical roller that extends longer than a width of the glossing belt 30, while defining an outwardly curved or rounded face where it touches the glossing belt 30. An outer surface of the guide roller 41U may be formed of a thermally resistant, anti-friction material that exhibits a sufficiently low coefficient of friction, such as, for example, fluorine resin or the like.

Specifically, the guide roller 41U defines a movable curved guide surface 41*a* for guiding the glossing belt 30 therealong toward the convex contact surface 42*a* of the belt cooler 42. The guide surface 41*a* is positioned to coincide with an imaginary, tangential plane A that is tangent to the convex contact surface 42*a* at a point B downstream from the upstream end of the belt cooler 42.

In such a configuration, the pair of guide members 41U and 41D works in a manner similar to that depicted in the foregoing embodiments. Compared to a stationary guide rib which can possibly slide against the belt, forming the guide member as a rotary body more effectively protects the belt against damage or abrasion, while reducing torque required to rotate the belt, leading to increased longevity of the belt assembly and more stable, smoother movement of the belt.

Although in the embodiment described above the belt guide 41 is configured as a single elongated guide member, guiding the endless rotary belt may be configured using multiple separate parts aligned with each other across the width of the belt. For example, instead of a single guide roller extending across the width of the glossing belt 30, the guide member 41 may be configured as a combination of multiple cylindrical rollers arranged coaxially with each other across the width of the glossing belt 30.

Hence, the fixing device 300 according to this patent specification can process a toner image using an endless rotary belt with high-gloss, high-quality imaging performance without compromising longevity of the belt assembly, as well as stable, smooth movement of the belt, owing to provision of the belt cooler 42 in combination with the belt guide 41, wherein the convex contact surface 42*a* of the belt cooler 42 establishes close, continuous contact with the belt surface to promote efficient transfer of heat from the belt to the belt cooler, while the belt guide 41 guides the belt during rotation such that the belt comes into contact with the contact surface 42*a* without contacting the upstream end of the belt cooler 42 for protecting the belt against damage or abrasion from forcibly sliding against the upstream end of the belt cooler 42. The image forming apparatus 100 incorporating the fixing device 300 according to one or more embodiments of this patent specification benefits from those and other effects of the fixing device 300.

As used herein, the term "fixing device" according to this patent specification encompasses any device including a pair of opposed rotary members to process a toner image on a recording medium with heat and pressure, the scope of which is not limited to those designed to simply fix a toner image, but include those designed to gloss an unfixed or pre-fixed toner image with heat and pressure. Also, the term "glossing device" herein encompasses any device including a pair of opposed rotary members to process a toner image on a recording medium with heat and pressure, the scope of which is not limited to those designed to gloss an unfixed or pre-fixed toner image with heat and pressure, but also include those designed to simply fix a toner image.

Although in several embodiments described herein, the glossing unit 300G is shown positioned immediately downstream from the fixing unit 300F along the sheet conveyance path, the fixing device 300 according to this patent specification may be configured otherwise than as specifically disclosed herein. For example, the glossing unit 300G may be provided at a separate position from the fixing unit 300F, such as exterior to the image forming apparatus 100. Moreover, the fixing device 300 may be configured without the fixing unit 300F, that is, the glossing unit 300G may serve to fix a toner image by applying heat and pressure to a recording medium S, insofar as the glossing unit 300G functions in a manner substantially identical to that of the fixing unit 300F.

Numerous additional modifications and variations are possible in light of the above teachings. It is therefore to be understood that, within the scope of the appended claims, the disclosure of this patent specification may be practiced otherwise than as specifically described herein.

What is claimed is:

1. A glossing device for processing a toner image on a recording medium, the device comprising:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler having a convex contact surface extending between upstream and downstream ends thereof in the conveyance direction of the belt to absorb heat from the belt; and a guide member inside the loop of the belt upstream from the contact surface of the belt cooler to guide the belt during rotation such that the belt comes into contact with the contact surface without contacting the upstream end of the belt cooler, wherein the guide member is an integral part of the belt cooler.

2. The glossing device according to claim 1, wherein the upstream guide member defines a convex guide surface for guiding the belt therealong toward the convex contact surface of the belt cooler, which coincides with an imaginary plane tangent to the convex contact surface at a given position downstream from the upstream end of the belt cooler.

3. The glossing device according to claim 1, wherein the guide member comprises a stationary rib.

4. The glossing device according to claim 1, wherein the guide member comprises a rotary body.

5. The glossing device according to claim 1, wherein the guide member comprises a single elongated member extending across the width of the belt.

6. The glossing device according to claim 1, wherein the guide member is at least partially formed of fluorine resin.

7. The glossing device according to claim 1, wherein the belt cooler further comprises a cooling jacket formed of aluminum, copper, or stainless steel.

8. The glossing device according to claim 1, wherein the convex contact surface of the belt cooler intrudes into a common tangent plane between the first and second rollers.

9. The glossing device according to claim 1, wherein at least one of the upstream and downstream ends of the belt cooler comprises a rounded edge.

10. A glossing device for processing a toner image on a recording medium, the device comprising:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler having a convex contact surface extending between upstream and downstream ends thereof in the conveyance direction of the belt to absorb heat from the belt;

an upstream guide member inside the loop of the belt upstream from the contact surface of the belt cooler to guide the belt during rotation such that the belt comes into contact with the contact surface without contacting the upstream end of the belt cooler; and a downstream guide member inside the loop of the belt downstream from the contact surface to guide the belt during rotation such that the belt separates from the contact surface without touching the downstream end of the belt cooler.

11. A glossing device for processing a toner image on a recording medium, the device comprising:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler having a convex contact surface extending between upstream and downstream ends thereof in the conveyance direction of the belt to absorb heat from the belt; and a guide member inside the loop of the belt upstream from the contact surface of the belt cooler to guide the belt during rotation such that the belt comes into contact with the contact surface without contacting the upstream end of the belt cooler, wherein at least one of the upstream and downstream ends of the belt cooler includes a chamfered edge.

12. A fixing device comprising:

a fixing unit to fix a toner image on a recording medium; and a glossing unit disposed downstream from the fixing unit to impart gloss to the fixed toner image, the glossing unit including:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler having a convex contact surface extending between upstream and downstream ends thereof to absorb heat from the belt;

an upstream guide member inside the loop of the belt upstream from the contact surface of the belt cooler to guide the belt during rotation such that the belt comes into contact with the contact surface without contacting the upstream end of the belt cooler; and a downstream guide member inside the loop of the belt downstream from the contact surface to guide the belt during rotation such that the belt separates from the contact surface without touching the downstream end of the belt cooler.

13. An image forming apparatus comprising:

an imaging unit to form a toner image on a recording medium; and a fixing device to process the toner image with heat and pressure on the recording medium, the fixing device including:

a first roller;

a second roller parallel to the first roller;

an endless rotary belt looped for rotation around the first and second rollers in a longitudinal, conveyance direction of the belt;

a third roller opposite the first roller via the belt;

a heater adjacent to the belt to heat the belt;

the first and third rollers pressing against each other via the belt to form a nip therebetween through which the recording medium is conveyed to process a toner image under heat and pressure, the recording medium after passage through the nip remaining in contact with the belt as the belt moves from the first roller toward the second roller, and separating from the belt as the belt passes around the second roller;

a belt cooler inside the loop of the belt downstream from the first roller and upstream from the second roller for cooling the belt, the belt cooler having a convex contact surface extending between upstream and downstream ends thereof to absorb heat from the belt;

means for guiding the belt during rotation such that the belt comes into contact with the contact, surface without contacting the upstream end of the belt cooler; and a downstream guide member inside the loop of the belt downstream from the contact surface to guide the belt during rotation such that the belt separates from the contact surface without touching the downstream end of the belt cooler.

* * * * *